US005741407A

United States Patent [19]

Yu

[11] Patent Number: 5,741,407

[45] Date of Patent: Apr. 21, 1998

[54] METHOD OF MANUFACTURING A SILVER-PLATED ALUMINUM CONDUCTOR, APPARATUS FOR IMPLEMENTING THE METHOD, AND A CONDUCTOR OBTAINED THEREBY

[75] Inventor: Ning Yu, Montmirail, France

[73] Assignee: Axon' Cable S.A., Montmirail, France

[21] Appl. No.: 532,676

[22] PCT Filed: Apr. 8, 1994

[86] PCT No.: PCT/FR94/00395

§ 371 Date: Oct. 6, 1995

§ 102(e) Date: Oct. 6, 1995

[87] PCT Pub. No.: WO94/24339

PCT Pub. Date: Oct. 27, 1994

[30] Foreign Application Priority Data

Apr. 9, 1993 [FR] France ..... 93 04243

[51] Int. Cl.[6] ..... C25D 17/00

[52] U.S. Cl. ..... 204/206

[58] Field of Search ..... 205/138, 139, 205/140, 149, 170, 182, 213, 263, 293, 300; 204/206

[56] References Cited

U.S. PATENT DOCUMENTS

| | | | |
|---|---|---|---|
| 2,266,330 | 12/1941 | Nachtman | 205/140 |
| 2,392,687 | 1/1946 | Nachtman | 204/206 |
| 2,686,859 | 8/1954 | Gray et al. | 204/28 |
| 4,886,585 | 12/1989 | Martinou et al. | 205/263 |
| 5,245,847 | 9/1993 | Bando et al. | 205/213 |

FOREIGN PATENT DOCUMENTS

| | | |
|---|---|---|
| 2650696 | 8/1989 | France . |
| 2650696 | 2/1991 | France . |
| 722449 | 1/1955 | United Kingdom . |

*Primary Examiner*—Kathryn L. Gorgos
*Assistant Examiner*—Edna Wong
*Attorney, Agent, or Firm*—Graham & James LLP

[57] ABSTRACT

The invention relates to a method of continuously manufacturing a conductor having a core S based on aluminum and coated by being electroplated with at least one layer of silver, characterized in that the following steps are performed in succession with intermediate rinsing steps (r):

a) the conductor is degreased;

b) oxide is removed from the conductor;

c) the surface of the conductor is treated in an adhesion bath;

d) a first layer of silver is electroplated by immersion in a first electrolytic bath; and e) a second layer of silver is electroplated by immersion in a second electrolytic bath.

3 Claims, 2 Drawing Sheets

METHOD OF MANUFACTURING A SILVER-PLATED ALUMINUM CONDUCTOR, APPARATUS FOR IMPLEMENTING THE METHOD, AND A CONDUCTOR OBTAINED THEREBY

This is a national stage application of PCT/FR94/00395 filed Apr. 18, 1994.

BACKGROUND OF THE INVENTION

The present invention relates to a method of manufacturing a silver-plated aluminum conductor, to the resulting silver-plated conductor, and to apparatus for implementing the method.

French patent application 89/10566 describes a method of manufacturing conductor wires made of silver-coated aluminum, the method comprising in succession: degreasing, oxide removal, surface treatment for causing metal seeds to adhere, and depositing a first layer and then a second layer of silver.

However, the efficiency and the speed of that method are not satisfactory. Furthermore, it does not produce silver-plated conductors whose qualities (appearance, adhesion of coating, solderability) are stable, particularly when the aluminum core is of small diameter. Also, manufacturing costs still remain too high and the effluents from the method is toxic and difficult to treat.

SUMMARY OF THE INVENTION

An object of the present invention is to solve the above technical problems by means of a method characterized in that the following steps are performed in succession together with intermediate rinsing steps:

a) the conductor is degreased by being immersed for 3 s to 100 s in a bath maintained at a temperature lying in the range 45° C. to 75° C. and comprising:

1 grams per liter (g/l) to 100 g/l of NaOH 1 g/l to 100 g/l of $Na_2CO_3$ 0 to 50 g/l of $Na_2SiO_3$ 1 g/l to 100 g/l of $NaC_6H_{11}O_7$;

b) removing oxide from the conductor by immersion for 2 s to 90 s in a bath at ambient temperature comprising nitric acid at a concentration lying in the range 10% to 60%;

c) treating the surface of the conductor by immersing it for 3 s to 100 s in an adhesion bath maintained at a temperature lying in the range 30° C. to 70° C. and comprising 50 milliliters per liter (ml/l) to 200 ml/l of $Ni(BF_4)_2$ and 10 ml/l to 80 ml/l of $Zn(BF_4)_2$;

d) electroplating a first layer of silver by immersion in a first bath at ambient temperature and comprising 50 g/l to 200 g/l of KCN and 1 g/l to 19 g/l of AgCN, using a current density lying in the range 0.1 amps per square decimeter ($A/dm^2$) to 10 $A/dm^2$ and anodes made of stainless steel; and e) electroplating a second layer of silver by immersion in a second bath comprising:

80 g/l to 300 g/l of KCN 45 g/l to 180 g/l of AgCN 10 g/l to 75 g/l of $K_2CO_3$ 0 to 50 g/l of KOH at a temperature lying in the range 30° C. to 60° C. and using a current density lying in the range 1 $A/dm^2$ to 10 $A/dm^2$ and silver anodes.

According to advantageous characteristics, the first layer of silver is obtained by immersion for 6 s at a current density of 3 $A/dm^2$ in a bath comprising 80 g/l of KCN and 5 g/l of AgCN and the second layer of silver is obtained by immersion for 40 s at a current density of 2.9 $A/dm^2$ in a bath at 47° C. and comprising:

220 g/l of KCN 115 g/l of AgCN 50 g/l of $K_2CO_3$ 30 g/l of KOH.

According to other characteristics, degreasing is performed by immersion for 8.5 s in a bath at 60° C. and comprising:

15 g/l of NaOH 10 g/l of $Na_2CO_3$ 5 g/l of $Na_2SiO_3$ 15 g/l of $NaC_6H_{11}O_7$, and oxide removal is performed by immersion for 6 s in a bath of nitric acid at 50%.

Also, the adhesion bath preferably comprises 95 ml/l of $Ni(BF_4)_2$ and 30 ml/l of $Zn(BF_4)_2$ and the surface treatment is performed by immersion for 8.5 s in a bath maintained at 43° C.

The method of the invention makes it possible to multiply manufacturing speed by five compared with prior methods for the same quality of electroplating.

Silver-plated aluminum conductors obtained using prior art methods have poor solderability qualities because of the poor adhesion of the silver coating on the aluminum core. That drawback becomes worse with decreasing core diameter.

The invention therefore also provides a conductor comprising an aluminum-based core coated with at least one layer of silver, characterized in that for a core diameter lying in the range 0.08 mm to 0.5 mm and for a total thickness of silver coating lying in the range 1 μm to 2 μm, the wetting angle lies in the range 25° to 42°.

The solderability of a conductor wire is expressed by its suitability for being wetted by solder in the molten state. In other words, the solder in the molten state adheres to the conductor properly so long as the surface of the conductor is wetted sufficiently by said liquefied solder. Wettability is associated with the "wetting" angle formed between the respective surfaces of the conductor and of the solder meniscus where they meet: the smaller the wetting angle, the better the wettability of the conductor with the solder being used.

Wetting angle is thus a parameter representative of the solderability of the conductor, and a wetting angle lying in the range 20° to 45° corresponds to solderability that is very satisfactory according to official standards (see French standard A 89-400-Nov 91 published by the Soldering and Welding Standardization Committee of the French Standards Body (AFNOR)).

The conductor obtained using the method of the invention on a core of very small diameter possesses silver coatings of small thickness with mechanical properties and in particular properties of solderability that are therefore completely satisfactory.

Patent application 89/10566 also describes electroplating apparatus for continuously coating a layer of metal on a conductor that is based, at least in part, on aluminum.

However, that apparatus is not suitable for implementing the method of the invention since it gives rise to technical problems both electrically and mechanically, in particular because of the small diameter of the aluminium core.

From an electrical point of view, during the step of electroplating silver on a continuous wire of small diameter, the ohmic drop along the wire immersed in the electrolyte bath can become very great, thereby creating a cathode voltage gradient.

In general, the current density in the length upstream is higher than in the length downstream, relative to the bath. Insofar as it is desired to accelerate the speed of electroplating, it is necessary to increase the mean current density, and that can cause hydrogen to be evolved.

Unfortunately, such gas evolution reduces electroplating efficiency and weakens the adhesion of the coating on the substrate-forming wire, particularly when the diameter of the wire is small.

From a mechanical point of view, the fine aluminum wire constituting the conductor core has low breaking strength. Unfortunately, to ensure good electrical connection with the wire, it is necessary to establish sufficient mechanical tension, particularly when electrical contact is obtained by the wire sliding over a connector.

It also turns out that contact by immersing the wire in a liquid gives rise to additional ohmic drops which are particularly troublesome.

An object of the apparatus of the present invention is to solve the above technical problems by providing electrical contact which is achieved by means of an apparatus for continuously coating a conductor whose core is based at least partially on aluminum, by electroplating at least one layer of silver, the apparatus being of the type comprising a line of tanks for containing various baths in which the conductor is immersed in succession, at least one current generator electrically connected firstly to the continuous conductor to be coated via at least one connector in contact with said conductor, and secondly to at least one anode-forming electrode immersed in the electroplating bath, a winder disposed at one of the ends of the line of tanks to co-operate with a payout reel disposed at the other end so as to displace the conductor from one bath to the next at a determined travel speed, the apparatus being characterized in that the connectors are constituted by pairs of rods between which the conductor slides and whose relative positions are adjustable so that it is possible to obtain optimum mechanical tension for establishing determined electrical contact as a function of the diameter of the conductor and as a function of its travel speed, and in that the connectors are disposed along the conductor at intervals that are predetermined as a function of its electrical resistance so as to avoid any evolution of hydrogen in the electroplating baths.

BRIEF DESCRIPTION OF THE DRAWINGS

The invention will be better understood on reading the following description and examples accompanied by drawings in which.

DESCRIPTION OF THE PREFERRED EMBODIMENTS

Figure 1:
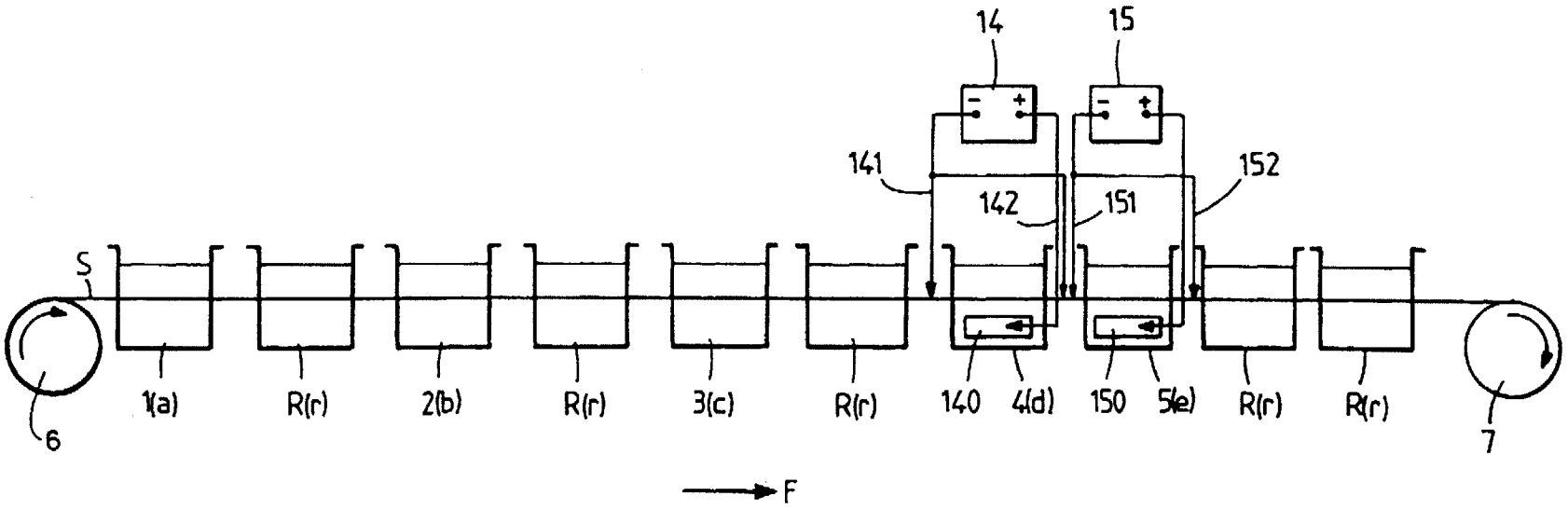
FIG. 1 is a diagrammatic view of apparatus for implementing the method of the invention.

The apparatus shown diagrammatically in FIG. 1 comprises a line of tanks (1–5,R) for containing various baths (a-e,r) and in which the aluminum core of a conductor S is immersed in succession for treating its surface and for providing the silver-plated coating.

Thus, going from upstream to downstream the following are found in succession, together with intermediate rinsing (r) tanks R:

a tank 1 having a degreasing bath (a) maintained at a temperature in the range 45° C. to 75° C. and comprising:

1 gram per liter (g/l) to 100 g/l of NaOH 1 g/l to 100 g/l of $Na_2CO_3$ 0 to 50 g/l of $Na_2SiO_3$ 1 g/l to 100 g/l of $NaC_6H_{11}O_7$ a tank 2 containing an oxide-removing bath (b) at ambient temperature comprising nitric acid at a concentration lying in the range 10% to 60 a tank 3 containing an adhesion bath (c) maintained at a temperature in the range 30° C. to 70° C. and comprising:

50 milliliters per liter (ml/l) to 200 ml/l of $Ni(BF_4)_2$ and 10 ml/l to 80 ml/l of $Zn(BF_4)_2$ a tank 4 containing a bath (d) at ambient temperature for electroplating the first layer of silver (pre-silvering) comprising:

50 g/l to 200 g/l of KCN and 1 g/l to 19 g/l of AgCN a tank 5 with a bath (e) maintained at a temperature in the range 30° C. to 60° C. for electroplating the second layer of silver and comprising:

80 g/l to 300 g/l of KCN 45 g/l to 180 g/l of AgCN 10 g/l to 75 g/l of $K_2CO_3$ 0 g/l to 50 g/l of KOH.

The apparatus also includes two current generators 14 and 15. The generator 14 is associated with the tank 4 and the bath (d) to electroplate the first layer of silver, while the generator 15 is associated with the tank 5 and the bath (e) to electroplate the second layer of silver. Naturally, it would be possible to design a feed for the electroplating circuits of both tanks 4 and 5 by using a common generator, however it is in any event necessary to be able to set current density to different values in the two tanks. Each generator 14 and 15 is electrically connected firstly to the continuous conductor S to be plated by means of at least one connector and preferably by means of two connectors 141, 142, 151, 152 placed in contact with the conductor S respectively upstream and downstream from each of the tanks 4 and 5 (upstream and downstream relative to the travel direction F) and secondly with anode-forming electrodes 140 and 150 which are immersed in the electroplating baths (d) and (e). The anode(s) 140 corresponding to the bath (d) are preferably made of stainless steel, whereas the anodes 150 corresponding to the bath (e) are made of silver. The distance between the upstream and downstream connectors 141, 151 and 142, 152 is determined as a function of the electrical resistance of the conductor S so as to reduce the cathode potential gradient, thereby avoiding hydrogen being evolved in the baths (d) and (e).

The potential from which hydrogen begins to be evolved is not far enough removed from that at which silver is electroplated. This means that if for any reason the cathode voltage varies from one point to another along the wire to be coated, electroplating will be disturbed by hydrogen evolving. Unfortunately, evolution of hydrogen, even if only in part, serves not only to reduce the efficiency of electroplating, but also degrades the adhesion of the silver deposit on the substrate and impedes good crystallization thereof, given that the mean electrical current density is given by the ratio of the total current divided by the surface area of the immersed wire, a cathode voltage gradient is equivalent to current density that is below average in the downstream portion of the immersed wire and that is above average in the upstream portion, thereby running the risk that hydrogen will therefore be evolved.

Under such conditions, the cathode potential gradient is reduced along the immersed wire by increasing the number of electrical contact points it has with the generator, and thus the number of connectors.

Thus, by calculating the ohmic drop due to the resistance of the wire and by estimating the voltage limit value that is not to be exceeded to ensure that evolution of hydrogen cannot occur, it is possible to deduce a limit length $L_M$ at the end of which an electrical contact must be established. Experience shows that the problem due to hydrogen evolution can be completely avoided providing the distance between two successive connectors is kept below $L_M$.

The apparatus also includes a winder 7 at the downstream end of the line of tanks designed to co-operate with a payout reel 6 disposed at the upstream end for the purpose of moving the conductor S from one bath to the next through the line of tanks.

Figure 2:
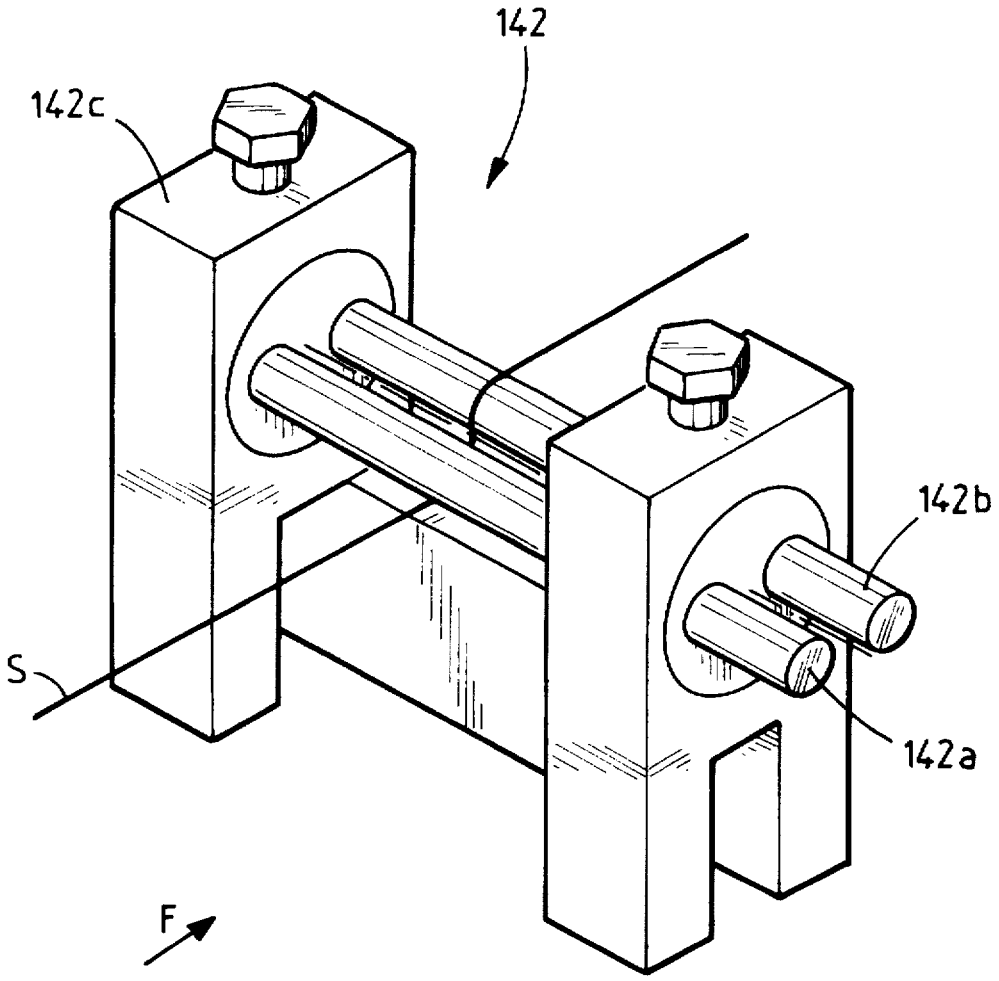
FIG. 2 is a perspective view of the connector used in the apparatus of the invention.

FIG. 2 is a perspective view of a connector of the invention.

The upstream connectors 141 and 151 are identical to the downstream connectors 142 and 152. Each connector comprises two brass rods 142*a* and 142*b* mounted to rotate freely about their respective longitudinal axes in an insulating support 142*c* (PVC). The two rods are adjacent and their longitudinal axes are parallel while their side faces are spaced apart by a distance that is substantially equal to the diameter of the conductor wire S.

In this manner, a good compromise is achieved between the mechanical tension on the wire S and the stability of electrical contact between the wire and the side faces of the rods, without causing the wire to break.

In addition, it is possible to obtain optimum mechanical tension of the conductor wire S as a function of its diameter and of its travel speed by adjusting the relative position of the rods. The conductor wire S travels in the direction F by sliding between the two rods 142*a* and 142*b* which are connected to the current generator 14 or 15.

EXAMPLE I

An aluminum alloy core was used having a diameter lying in the range 0.08 mm to 0.5 mm.

The following operations were performed in succession together with intermediate rinsing operations:

a) Degreasing for 8.5 seconds (s) in a bath at a temperature 60° C. and comprising:

15 g/l of NaOH 10 g/l of $Na_2CO_3$ 5 g/l of $Na_2SiO_3$ 15 g/l of $NaC_6H_{11}O_7$ b) Oxide removal for 6 s in 50% nitric acid at ambient temperature.

c) Pretreatment for 8.5 s in a bath at 43° C. comprising:

95 m/l of $Ni(BF_4)_2$ 30 m/l of $Zn(BF_4)_2$ d) Pre-silvering by immersion for 6 s at a current density of 3 amps per square decimeter ($A/dm^2$) in a bath at ambient temperature comprising:

80 g/l of KCN 5 g/l of AgCN

The thickness of the resulting first layer of silver constituted approximately 13% of the total thickness of silver.

e) Silver-plating by immersion for 40 s at a current density of 2.9 $A/dm^2$ in a bath at 47° C. comprising:

220 g/l of KCN 115 g/l of AgCN 50 g/l of $K_2CO_3$ 30 g/l of KOH

Examples II to IX of the method were performed in the same manner as Example I.

The parameters of Examples I to IX are summarized in Table A below.

Table B relates to various samples of conductors manufactured using the method of the invention and giving their wetting angles.

Silver-plated conductors obtained by the method of the invention are particularly suitable for applications such as electric cables in the aviation and space industries.

TABLE A

| | Step a | | Step b | Step c | | Step d | Step e | | Thickness of first | Thickness of second | Total thick- |
|---|---|---|---|---|---|---|---|---|---|---|---|
| Example | ta (s) | Ta (°C.) | tb (s) | tc (s) | Tc (°C.) | i ($A/dm^2$) | Te (°C.) | i ($A/dm^2$) | Ag layer (μm) | Ag layer (μm) | ness (μm) |
| I | 8.5 | 60 | 6 | 8.5 | 43 | 3.0 | 47 | 2.9 | 0.13 | 0.87 | 1.0 |
| II | 8.5 | 75 | 6 | 8.5 | 70 | 3.0 | 60 | 3.0 | 0.13 | 0.87 | 1.0 |
| III | 8.5 | 45 | 6 | 8.5 | 30 | 3.0 | 30 | 3.0 | 0.13 | 0.87 | 1.0 |
| IV | 95 | 60 | 67 | 95 | 43 | 3.0 | 47 | 3.0 | 0.26 | 1.74 | 2.0 |
| V | 4.2 | 60 | 3 | 4.2 | 43 | 3.0 | 47 | 3.0 | 0.13 | 0.87 | 1.0 |
| VI | 8.5 | 60 | 6 | 8.5 | 43 | 8.0 | 47 | 3.0 | 0.57 | 1.43 | 2.0 |
| VII | 8.5 | 60 | 6 | 8.5 | 43 | 0.2 | 47 | 3.0 | 0.01 | 1.99 | 2.0 |
| VIII | 8.5 | 60 | 6 | 8.5 | 43 | 3.0 | 47 | 8.0 | 0.10 | 1.90 | 2.0 |
| IX | 8.5 | 60 | 6 | 8.5 | 43 | 3.0 | 47 | 1.0 | 0.31 | 0.69 | 1.0 |

t: processing time
T: temperature
i: current density

TABLE B

| Sample | Aluminum alloy | Wire diameter (mm) | Total thickness of silver (μm) | Wetting angle (degrees) |
|---|---|---|---|---|
| 1 | 5154(1) | 0.08 | 1.0 | 41 |
| 2 | 131050(2) | 0.10 | 1.0 | 38 |
| 3 | 131050 | 0.12 | 2.0 | 31 |
| 4 | 131050 | 0.13 | 1.0 | 38 |
| 5 | 131050 | 0.16 | 1.0 | 36 |

TABLE B-continued

| Sample | Aluminum alloy | Wire diameter (mm) | Total thickness of silver (μm) | Wetting angle (degrees) |
|---|---|---|---|---|
| 6 | 131050 | 0.20 | 1.0 | 35 |
| 7 | 131050 | 0.25 | 1.0 | 42 |
| 8 | 131050 | 0.29 | 1.0 | 39 |
| 9 | 131050 | 0.41 | 2.0 | 25 |

(1)Alloy 5154 according to Standard NF-A-02104
(2)An alloy from Pechiney.

I claim:

1. Apparatus for continuously coating a conductor whose core is based at least partially on aluminum, the apparatus comprising means for electroplating at least one layer of silver, the apparatus comprising a line of tanks for containing various baths in which the conductor is immersed in succession, at least one current generator electrically connected firstly to the conductor to be coated via at least one connector in contact with said conductor, and secondly to at least one anode-forming electrode immersed in at least one electroplating bath, a winder disposed at one of the ends of the line of tanks to co-operate with a payout reel disposed at the other end to displace the conductor from one bath to the next at a determined travel speed, wherein the connectors are comprised of pairs of parallel rods disposed perpendicularly with a direction of displacement of said conductor and between which the conductor slides, said pairs of rods being rotatable about a common axis to alter relative positions of said rods with respect to said conductor to obtain optimum mechanical tension for establishing determined electrical contact as a function of a diameter of the conductor and as a function of its travel speed, and wherein the connectors are disposed along the conductor at intervals that correspond to its electrical resistance to avoid any evolution of hydrogen in the electroplating baths.

2. Apparatus according to claim 1, wherein said at least one electroplating bath further comprises two tanks respectively containing a pre-silvering bath and a silver-plating bath.

3. Apparatus according to claim 2, wherein the at least one anode-forming electrode of the pre-silvering bath is comprised of stainless steel and the at least one anode-forming electrode of the silver-plating bath is comprised of silver.

* * * * *